US006596221B1

(12) United States Patent
Fuchs

(10) Patent No.: US 6,596,221 B1
(45) Date of Patent: Jul. 22, 2003

(54) METALLURGICAL VESSEL HAVING A TAPPING DEVICE AND METHOD FOR THE CONTROLLED, SLAG-FREE EXTRACTION OF MOLTEN METAL FROM SAID VESSEL

(75) Inventor: Gerhard Fuchs, Kehl-Bodersweier (DE)

(73) Assignee: Arcmet Technologie GmbH, Linz (AT)

( * ) Notice: Subject to any disclaimer, the term of this patent is extended or adjusted under 35 U.S.C. 154(b) by 0 days.

(21) Appl. No.: 09/937,734

(22) PCT Filed: Mar. 31, 2000

(86) PCT No.: PCT/EP00/02903

§ 371 (c)(1),
(2), (4) Date: Sep. 28, 2001

(87) PCT Pub. No.: WO00/60297

PCT Pub. Date: Oct. 12, 2000

(30) Foreign Application Priority Data

Apr. 1, 1999 (DE) ..... 199 14 982
Apr. 28, 1999 (DE) ..... 199 19 378

(51) Int. Cl.[7] ..... C22B 7/04

(52) U.S. Cl. ..... 266/45; 266/239; 266/240; 266/94; 222/590; 222/593; 373/142; 373/143

(58) Field of Search ..... 222/590, 593; 266/45, 239, 240, 94; 373/142, 143

(56) References Cited

U.S. PATENT DOCUMENTS 5,305,990 A * 4/1994 Sherwood ..... 266/205
5,908,488 A * 6/1999 Schroder et al. ..... 266/239

FOREIGN PATENT DOCUMENTS

| | | |
|---|---|---|
| AT | 3 85 052 B | 2/1988 |
| DE | 113 574 | 5/1899 |
| DE | AS 11 80 092 | 10/1964 |
| DE | 30 49 053 C2 | 9/1983 |
| DE | 40 33 304 A1 | 4/1992 |
| EP | 0 960 862 A1 | 1/1999 |
| FR | 2 034 841 A | 12/1970 |
| JP | 60108146 | 6/1985 |
| WO | WO 86/04980 | 8/1986 |

* cited by examiner

*Primary Examiner*—Melvyn Andrews
(74) *Attorney, Agent, or Firm*—Foley Hoag LLP

(57) ABSTRACT

In a metallurgical vessel (1) having a tapping apparatus (5) for the slag-free withdrawal of liquid metal (3) from a molten metal bath (3) which is disposed in the vessel (1), a first leg (11) of a discharge duct (10) passes through the refractory vessel wall (15) and an overflow edge (14) in the connecting region of the two legs (11, 12) of the discharge duct (10) is higher than the upper edge (18) of the inlet opening (17) of the discharge duct. The molten metal (3) in the discharge duct is preferably inductively heatable.

35 Claims, 4 Drawing Sheets

METALLURGICAL VESSEL HAVING A TAPPING DEVICE AND METHOD FOR THE CONTROLLED, SLAG-FREE EXTRACTION OF MOLTEN METAL FROM SAID VESSEL

TECHNICAL FIELD

The invention concerns a metallurgical vessel having a tapping apparatus for the controlled slag-free withdrawal of liquid metal. The invention also relates to a process using such a tapping apparatus.

WO 86/04980 discloses an apparatus and a process for transferring a predetermined amount of liquid metal from a receiving container containing a molten metal bath, by means of a discharge pipe with a refractory lining, using the principle of a liquid siphon. The discharge pipe is in the form of an inverted U or V with two downwardly facing legs, of which the first has an inlet opening and the second has an outlet opening for the liquid metal, which can be gas-tightly closed by a closure device. Provided in the upper region of the discharge pipe is a pipe connection which can be connected to a vacuum device and which has a refractory lining and which can be selectively connected to the vacuum device by way of a first valve or communicated with the free atmosphere by way of a second valve. For the purposes of transferring a predetermined amount of liquid metal from the vessel containing a molten metal bath, in particular a smelting furnace vessel, the first leg of the discharge pipe whose second leg is gas-tightly closed by the closure device is immersed in the molten metal bath through a closable opening in the wall of the upper vessel portion formed by water-cooled elements, the second valve which acts as a ventilation valve is closed and the first valve is opened to communicate the discharge pipe with the vacuum device. The vacuum suction effect of the vacuum device causes the molten metal to be lifted in the first leg and it passes into the second leg over an overflow edge in the connecting region of the two legs. When the second leg is filled, the closure device of the second leg is opened and the liquid metal is transferred on the basis of the principle of the liquid siphon into the receiving container, preferably a ladle. By closure of the first valve which makes the communication with the vacuum device and opening of the second valve which acts as a ventilation valve, the flow through the discharge duct can be interrupted so that controlled, slag-free withdrawal of the molten metal is possible. In order to prevent slag from passing into the discharge pipe when the first leg is immersed in the molten metal bath through a layer of slag, the inlet opening, prior to being immersed in the molten metal bath, is closed by a plate which, after immersion, melts and opens the inlet opening. To protect the closure plate member of the closure device, prior to tapping of the furnace vessel granular refractory material is introduced into the second leg which moreover has a constriction in the lower region.

DE-C 605 701 discloses a siphon for emptying thermal baths, in which an ejector nozzle is installed in the suction pipe which is surrounded by a heating casing. The ejector nozzle, together with the suction pipe, is heated. The ejector nozzle produces a reduced pressure with which the procedure for the controlled withdrawal of the liquid from the vessel is initiated.

In the known processes and apparatuses for the withdrawal of liquid metal using the principle of a liquid siphon, a leg of the discharge pipe which is in the form of an inverted U or V is immersed in the molten metal bath. The upper direction-changing region of the discharge pipe is disposed above the maximum height of the molten metal surface. Therefore, to initiate the tapping procedure, the molten metal must be raised by more than the difference in height between the direction-changing region and the surface of the molten metal. That makes a vacuum device necessary to initiate the tapping procedure.

STATEMENT OF THIS INVENTION

The object of the present invention, in a metallurgical vessel having a tapping apparatus, irrespective of the size of the vessel, is to permit reliable controlled slag-free withdrawal of liquid metal. The invention aims to set forth various modifications in the tapping apparatus in which it is possible to initiate the tapping procedure without a reduced pressure, so that there is no need for a vacuum device. Finally the invention also seeks to provide a process for the controlled, slag-free withdrawal of liquid metal from a metallurgical vessel, using an apparatus of that kind.

Advantageous configurations of the tapping apparatus, in accordance with the invention, are to be found in the embodiments described herein. Advantageous configurations of the process, in accordance with the invention, are also to be found in the embodiments described herein.

In the case of the present invention the discharge duct is integrated with one leg into the wall of the vessel and the height of the overflow edge in the connecting region of the two legs of the discharge duct is established in such a way that it is possible to eliminate the vacuum device for initiating the tapping operation. In that respect, by pressure equalisation between the free atmosphere and the connecting region of the two legs, preferably by way of a ventilation valve or by actuation of the closure device it is possible for the tapping operation to be rapidly broken off at any time, so that it is possible to ensure that, when the liquid metal is withdrawn, no slag is also entrained from the layer of slag which floats on the molten metal.

BRIEF DESCRIPTION OF THE DRAWINGS

The invention is described in greater detail by means of three embodiments with reference to five Figures of drawing in which.

MODES OF CARRYING OUT THE INVENTION

Figure 1:
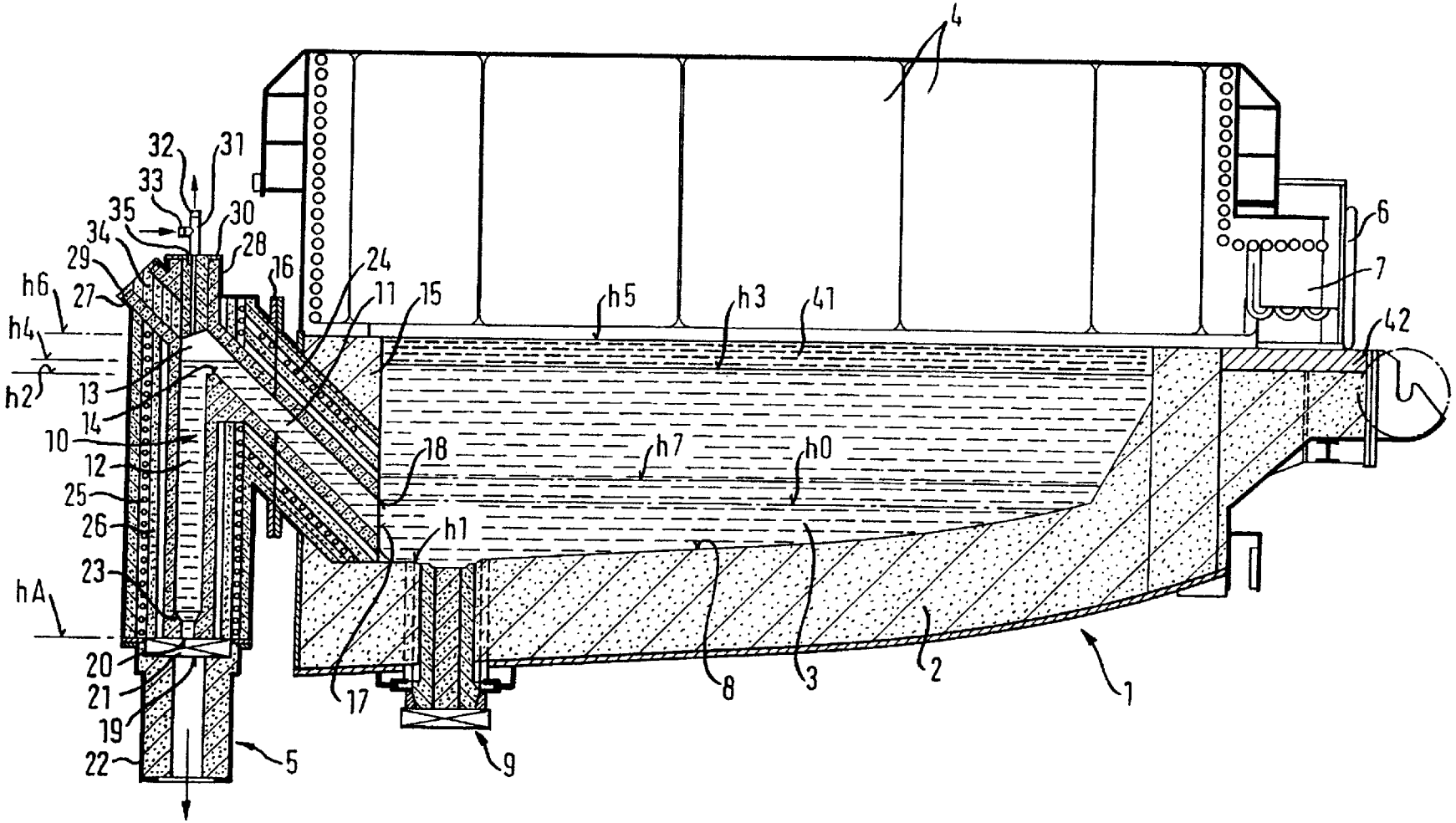
FIG. 1 is a view in section of a metallurgical vessel having a tapping apparatus.

As an example of a metallurgical vessel, FIG. 1 shows a view in section of the furnace vessel 1 of an electric arc furnace. The furnace vessel 1 comprises a lower vessel portion 2 forming the brick-built furnace hearth, for receiving the molten metal 3, and an upper vessel portion 4 which is formed from water-cooled elements. In the view shown in FIG. 1, a tapping apparatus 5 is disposed on the left-hand side of the furnace vessel and a slag opening 7 which is closable by means of a slag door 6 is disposed on the right-hand side. The bottom of the lower vessel portion 2 falls away towards the tapping apparatus 5. Disposed at the lowest location of the bottom contour 8 is a bottom tapping 9 of conventional kind, which is used when the furnace vessel is to be emptied completely, for example before the furnace is taken out of operation, for the purposes of repairing it or re-lining it. The furnace vessel can be adapted to be tilted in the direction of the tapping apparatus 5, in known manner. The tapping apparatus according to the invention however does not make it necessary to tilt the vessel so that there is no need for structural features for tilting the furnace vessel and, in the case of scrap preheating shafts, for lifting the shaft before the furnace vessel is tilted. In the case of a fixed furnace, the water cooling elements at the tapping side can then also be of the same length as the other water cooling elements, so that it is possible to make further savings in respect of refractory material in the wall of the vessel.

Figure 2:
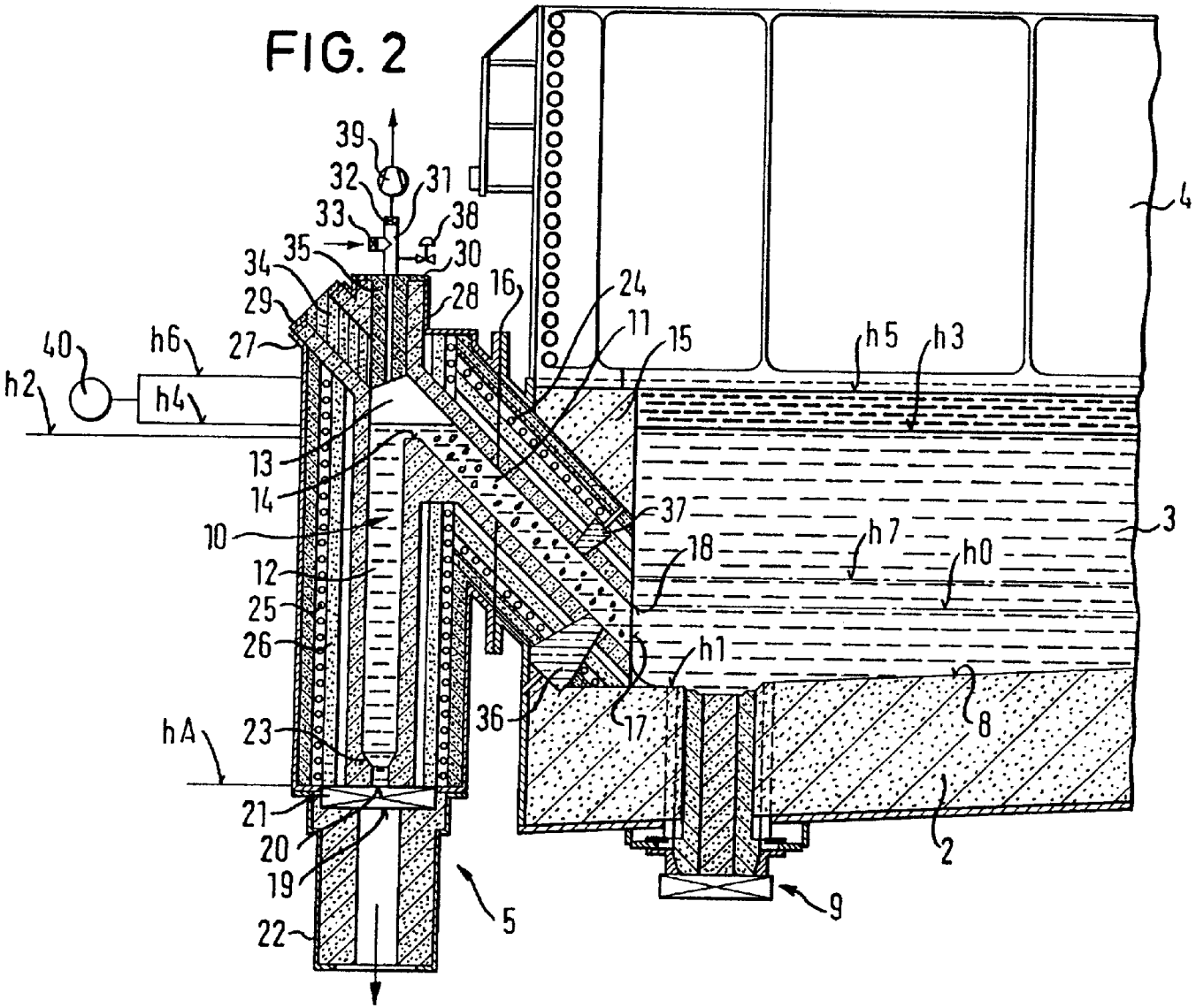
FIG. 2 is a view on an enlarged scale of the part of the vessel which includes the tapping apparatus, with some modifications.

In the case of the furnace vessel 1 shown in FIGS. 1 and 2, the tapping apparatus 5 which is designed on the basis of the principle of a liquid siphon includes a discharge duct 10 which is surrounded by a refractory material and which is in the form of an inverted V with two downwardly facing legs 11 and 12 which are connected at the top. In the connecting region 13 between the two legs, an overflow edge 14 for the liquid metal 3 is defined within the discharge duct 10. The first leg 11 of the discharge duct passes through the refractory vessel wall 15 of the lower vessel portion 2, rising inclinedly as viewed from the interior of the furnace. The second leg 12 is disposed outside the furnace vessel 1 and faces perpendicularly downwardly, parallel to the vessel wall 15. For reasons of production and maintenance, the region of the tapping apparatus 5, which is disposed outside the refractory vessel wall 15, is connected by means of a flange 16 to the part of the discharge duct 10, which passes through the refractory vessel wall.

The first leg 11 of the discharge duct 10 has an inlet opening 17 with an upper edge 18 which defines a height h0.

The second leg 12 of the discharge duct 10 has an outlet opening 20 for the liquid metal 3. The outlet opening 20 can be closed by a closure device 19 and it is lower than the upper edge 18 of the inlet opening 17 of the discharge duct 10, at a height identified by hA. The closure device 19 is only diagrammatically illustrated by means of a closure plate member 21 which is repeatedly movable by means of a drive from a closing position of bearing against the edge of the outlet opening 20 into an open position of opening the outlet opening 20, and from the open position into the closing position. When the tapping operation is initiated by way of a residual amount which has been held back in the second leg 12 from the preceding tapping procedure or by way of an overflow amount of the molten metal 3 which has previously flowed thereinto over the overflow edge 14 of the discharge duct, there is no need to make particular demands, in terms of sealing integrity of the closure effect achieved by the closure device. If a vacuum device is used to initiate the tapping procedure when the second leg 12 is empty, then, in order not substantially to reduce the effect of the vacuum suction action, the closure device 19 is to be designed to provide a gas-tight closure action. Ceramic slider members and closure devices in which the closure plate member is pressed against the outlet opening, possibly with the use of a seal, are particularly suitable for that purpose.

The second leg 12 of the discharge duct 10 is prolonged downwardly by a protective pipe 22 which, when tapping off the furnace vessel 1 into a ladle, surrounds the jet of metal and thus shields it from the free atmosphere.

In order substantially to prevent turbulence in the flow of liquid within the discharge duct, the through-flow cross-section of the discharge duct is comparatively large and a portion 23 of reduced through-flow cross-section, for limiting the flow therethrough, is provided just upstream of the outlet opening 20. As that portion 23 is subjected to a particular loading by virtue of the higher speed of flow of the liquid therethrough, it is in the form of an independent, replaceable portion (not shown). Apart from the portion of reduced through-flow cross-section which is preferably of a circular cross-section in order to form a flow of circular cross-section, in the illustrated embodiment the through-flow cross-section of the discharge duct, at least in the region of the inlet opening 17 of the first leg 11, is of a rectangular configuration or an oval configuration of greater width than height, so that the upper edge 18 of the inlet opening 17, which determines the liquid sump which remains behind in the tapping operation, is disposed as far downwardly as possible. Dimensions for the internal cross-section of the inlet opening 17, involving a width of about 30 cm and a height of about 20 cm, have proven to be advantageous.

In order to keep a molten metal present in the discharge duct in the liquid condition, in regard to unimpeded discharge flow of the molten metal in the tapping operation, or in order to again liquefy a residual molten metal which has set, the refractory material surrounding the discharge duct or molten metal disposed in the discharge duct can be heated by means of a heating device. In the illustrated structure, the apparatus has inductive heating by means of a first induction coil 24 surrounding the first leg 11 of the discharge duct 10 and a second induction coil 25 surrounding the second leg 12 of the discharge duct 10. The induction coils can be operated separately with alternating current so that, according to the respective requirements involved, it is possible to heat up molten metal in the first leg 11 or molten metal in the second leg 12. Disposed between the turns of the induction coils 24 and 25 and the legs 11 and 12 of the discharge duct 10 with its refractory lining are insulating layers 26 in order to reduce the flow of heat from the discharge duct to the cooled turns of the induction coils 24 and 25. In the current-less condition, the positively cooled turns of the induction coils 24 and 25 can also be used to cool a molten metal which has been retained in the discharge duct. In that case, the insulating layers 26 are omitted.

In the illustrated embodiment, pipe connections 27 and 28 which are lined with refractory material are respectively provided in alignment with the respective legs 11 and 12 of the discharge duct 10, in the connecting region 13 between the two legs 11 and 12. The first pipe connection 27 which is aligned with the first leg 11 can be gas-tightly closed by means of a flange 29. The second pipe connection 28 which is aligned with the second leg 12 can be connected by way of a second flange 30 to at least one external device. For that purpose, the second flange 30 is provided with a connecting pipe 31 to which a vacuum device 39 diagrammatically illustrated in FIG. 2 can be connected by way of a first valve 32. Disposed in a branch from the connecting pipe 31 is a second valve which is identified as a ventilation valve 33 as a communication can be made with the free atmosphere, when that valve is opened. To reduce the free volume in the connecting region 13 between the two legs 11 and 12, refractory plugs 34 and 35 are disposed at the insides of the flanges 29 and 30. When the flanges 29 and 30 are removed, the interior of the legs 11 and 12 respectively aligned with the corresponding pipe connections is accessible, for inspection and maintenance purposes. At least one of the pipe connections can also be used to connect a burner, either instead of the induction heating arrangement or in addition thereto, as a heating device for the discharge duct or molten metal disposed in the discharge duct.

FIG. 2 which shows a view on an enlarged scale of the part of the vessel which includes the tapping apparatus illustrates some modifications and additional items of equipment which are advantageous in regard to the mode of operation of the tapping apparatus in some alternative configurations.

Provided in the proximity of the inlet opening 17 of the discharge duct 10 is a porous flushing or scavenging brick 36 which can be connected to a pressurised gas source by way of a pressurised gas line and which opens from below into the discharge duct 10, for the introduction of a gas, preferably an inert gas such as argon. The introduction of gas which rises upwardly in the first leg 11 and which can escape by way of the opened ventilation valve 33 causes molten metal to be entrained, and in that way the liquid metal is raised in the first leg to a level over the overflow edge 14. That entrainment effect can be used instead of or in addition to a vacuum suction effect caused by the vacuum device 39.

As an alternative to or in addition to inductive heating of the first leg, solidification of the molten metal in that leg can also be prevented by the provision, in the proximity of the inlet opening 17 of the discharge duct, of a second porous flushing or scavenging brick 37 which can be connected to a pressurised gas source by way of a pressurised gas line and which opens at the top side of the discharge-duct and with which it is possible to provide for circulation of the liquid metal in the first leg. That causes hot metal to be passed from the vessel 2 into the colder region of the first leg, and thus resists hardening of the metal in that region. It is also possible to provide a porous flushing or scavenging brick in the bottom of the lower vessel portion 2, for example at a similar location to the bottom tapping 9, in the proximity of the inlet opening 17 of the discharge duct, in order to counteract a cooling effect by circulation in that region.

When using a vacuum device 39, in order to ensure that, at the maximum bath level h3 in the vessel, the bath level h4 in the connecting region 13 of the discharge duct 10 is not raised to such an extent that it passes into the feed line to the vacuum device or into a burner connected to the pipe connection 27, the arrangement includes a device which is identified in FIG. 2 by reference numeral 40, for detecting and controlling the height of the bath level h4 in the connecting region 13 of the two legs 11 and 12 of the discharge duct 10. The device 40 includes a level sensor which detects the height of the bath level h4 and whose output signal, by way of a regulating circuit, regulates for example the reduced pressure produced by the vacuum device 39. The reduced pressure which acts in the connecting region 13 of the two legs 11 and 12 can then also be regulated, using a vacuum device 39 which delivers a constant reduced pressure, by a procedure whereby the control signals supplied by the level sensor are fed to a regulating valve 38 by which additional leakage or secondary air is controlledly fed into the intake region of the vacuum device 39, to maintain the level h4 which is set as the reference value. The regulating device for maintaining a predetermined height for the bath level h4 is unnecessary if the length of the pipe connections 27 and 28 is of such a magnitude that the endangered elements are always disposed above the maximum suction height or head of the molten metal.

If the tapping apparatus 5 is designed and operated in such a way that, in each tapping operation, the second leg is emptied completely, then preferably, as is known from above-mentioned WO 86/04980, granular refractory material is introduced into the second leg from above after the tapping operation and after the outlet opening 20 of the discharge duct 10 has been closed again by means of the closure plate member 21. In that case, the second pipe connection 28 which is aligned with the second leg 12 of the discharge duct 10 is used to connect a container with granular refractory material, as an external device, by way of a suitable feed conduit and a metering device. The connecting pipe 31 for the connection of a vacuum device and the possibility of communication with the free atmosphere by way of the ventilation valve 33 can then be associated with the first flange 29 which is aligned with the first leg 11 of the discharge duct 10.

In regard to initiating and implementing the tapping procedure, a number of modifications are possible, depending on the respective design configuration of the tapping apparatus 5, the most important of such modifications being described hereinafter.

In this respect, the height parameters h1 to h7 and hA shown in FIG. 1 play a part. The definitions for those height parameters, which have already been set forth in the description hereinbefore, are once again summarised and supplemented hereinafter. In the case of a tiltable vessel, the height parameters relate to the tilted and the non-tilted condition (see FIGS. 3 and 5). The meanings involved are as follows:

hA=height of the outlet openings 20 of the discharge duct 10, which can be closed by the closure plate member 21 h0=height of the upper edge 18 of the inlet opening 17 of the discharge duct h1=height of the bottom contour 8 in front of the inlet opening 17 h2=height of the overflow edge 14 h3=height of the maximum permissible level of the molten metal bath 3 h4=height of the molten metal in the connecting region 13 of the discharge pipe 10 h5=height of the surface of a layer of slag 41 floating on the molten metal bath h6=height of the closure by the plugs 34 and 35 in the connecting region of the two legs 11 and 12, and h7=height of the level of the molten metal bath, at which slag is drawn into the discharge duct 10 by intake eddies.

In the case of the tapping apparatus shown in FIG. 1, the height h2 of the overflow edge 4 is approximately at the same height as the maximum permissible level h3 of the molten metal bath 3. As the layer of slag 41 applies a weight loading to the molten metal 3 in the vessel 1, the height h4 of the level of the molten metal bath 3 in the discharge duct is somewhat greater than h3. This means that, shortly before the maximum bath level h3 in the vessel 1 is reached, molten metal flows over from the first leg 11 into the second leg 12 and fills that leg of the discharge duct 10. That condition just before the tapping operation is shown in FIG. 1. The free volume in the connecting region 13 is kept small, by virtue of a slight difference between the heights h6 and h4. If, in that condition, by virtue of opening of the ventilation valve 33, atmospheric pressure is created in the free space of the connecting region 13 and thereafter the ventilation valve is closed, then, without the need for a vacuum device, after the outlet opening 20 is opened by the closure plate member 21, when the molten metal in the second leg 12 flows away, the molten metal present in the first leg 11 is also pulled along and entrained out of the vessel 1, with that molten metal. The discharge flow on the basis of the principle of a liquid siphon continues until slag and therewith air from the layer of slag 41 which falls with the level of the molten metal bath is drawn into the discharge duct by way of the upper edge 18 of the inlet opening 17 of the discharge duct. When the level of the molten metal bath 3 in the vessel 1 has reached the height h0, the tapping operation is automatically terminated by slag and air being drawn in; it will be appreciated that in that case small amounts of slag pass into the discharge duct and therewith into the tapped-off metal.

By virtue of intake eddies above the upper edge 18 of the inlet opening 17 of the discharge duct 10, small amounts of slag are already drawn into the discharge duct 10 before the level of the molten metal bath 3 has reached the height h0. The height at which slag begins to be drawn into the discharge duct due to the action of intake eddies is identified by h7. If any intake flow of slag is to be prevented, the tapping procedure must therefore be terminated when the level of the molten metal bath 3 has reached the height h7. Termination of the tapping procedure can be effected either by closing the outlet opening 20 of the discharge duct 10 by means of a suitable closure device 19, by opening of the ventilation valve 33, that is to say by a feed of leakage secondary air into the connecting region 13 of the two legs 11 and 12 or in the case of a tiltable vessel by tilting the vessel back. In the first-mentioned situation, the second leg 12 remains at least partially filled with a residual amount of molten metal. In the other situations the second leg 12 is emptied completely.

As described, an amount of molten metal which is present in the second leg 12 is sufficient for initiating and effecting the tapping procedure, if the suction effect caused when that molten material runs away is enough to draw the molten metal 3 from the vessel by way of the first leg into the second leg. Essential considerations in that respect are the size of the free space in the connecting region 13 of the two legs 11 and 12 and the volume of the molten metal which is present in the second leg 12 when the tapping procedure is initiated. Finally, an essential part is also played by the flow conditions in the discharge duct 10, which can be influenced by the reduction in the through-flow cross-section upstream of the outlet opening 20.

If, with the tapping apparatus according to the invention, only one tapping operation is intended on each occasion that the maximum bath level h3 is reached, then the tapping procedure, with the conditions in respect of height as shown in FIG. 1, as described, can be effected without involving the use of a vacuum device, solely by means of the overflow amount or residual amount of molten metal which is present in the second leg 12, in which case that molten metal is possibly to be put into a liquid condition by the heating arrangement 24, 25.

If the height h2 of the overflow edge 14 is arranged lower than the height h3 of the maximum level of the molten metal bath, for example due to a reduction in the angle of inclination of the first leg 11, then an overflow of the molten metal 3 into the second leg 12 is guaranteed even if the level of the molten metal bath in the vessel 1 is below the maximum height h3, more specifically until the level of the molten metal bath has approximately reached the height h2. In that region therefore with a suitable configuration in respect of the volume of the second leg, the arrangement also always ensures reliable initiation of the tapping procedure by virtue of the molten metal also being entrained out of the first leg. If the overflow edge 14 is set lower, then when the material is melted in the vessel 1 transfer into the second leg 12 already takes place some time before the maximum bath level h3 is reached, and here cooling and hardening of the molten metal must preferably be resisted by means of inductive heating and/or by introducing a gas by way of the flushing or scavenging brick 37 or 36 respectively. The height h0 of the upper edge 18 of the inlet opening 17 of the discharge duct is considered as the lowermost limit for the height h2 of the overflow edge 14. Preferably however the height h2 does not fall below the height h7, in other words, the following should apply: h2 >h7. In the case of a tiltable furnace vessel those heightwise details relate to the tilted condition.

If the height h2 of the overflow edge 14 is selected to be higher than the height h3 of the maximum level of the molten metal bath 3, or if a plurality of partial amounts are to be successively withdrawn from the vessel 1 with the tapping apparatus 5, and in that situation the respective tapping procedures are each interrupted with emptying of the second leg, then a vacuum device is required to initiate the tapping procedure; in the illustrated example, the vacuum device can be connected to the connecting duct 31 by way of the valve 32. The size of the vacuum device is to depend on the respective column of liquid metal to be lifted. Lower suction pressures could also be implemented by the use of ejector nozzles based on the principle of DE-C 605 701 referred to in the opening part of this specification. A slight rise in the bath level in the first leg can also be achieved by the introduction of gas through the porous flushing or scavenging brick 36 or 37, by virtue of the entrainment effect.

A tapping process with the tapping apparatus 5 shown in FIG. 1 is described hereinafter.

After a tapping procedure, the outlet opening 20 of the discharge duct 10 is closed and granular refractory material is introduced into the lower portion of the second leg 12. At the same time the smelting furnace 1 has been charged with charge material and the next charge is being smelted. In that situation, the level of the bath in the smelting vessel 1 rises and at the same time it rises in the first leg 11 of the discharge duct. In order to prevent cooling of the molten metal in the first leg 11, the induction coil 24 is supplied with current and/or gas is introduced through the flushing or scavenging brick 37 or 36 respectively. Shortly before the maximum bath level h3 is reached in the smelting vessel 1, molten metal flows out of the first leg 11 over the overflow edge 14 into the second leg 12 and fills same; in this case also, cooling is prevented by supplying the induction coil 25 with current, that is to say, by inductive heating of the molten metal. During the smelting procedure, the ventilation valve 33 is opened in order to prevent a pressure from building up in the connecting region 13 of the two legs 11 and 12.

Prior to the tapping operation the ventilation valve 33 is closed again and the tapping procedure is initiated by opening the closure device. With the overflow amount which is being discharged in the second leg 12, molten metal is pulled out of the first leg 11 and the furnace vessel until the height h7 is reached. By the ventilation valve 33 being opened, the tapping procedure is interrupted by means of a feed of leakage secondary air, in order to prevent slag from being drawn in. An amount of liquid metal corresponding to the bath level remains as a sump in the vessel. After the closure device 19 is closed again and after refractory material capable of trickle flow is introduced, the described procedure is repeated.

If only partial amounts are to be tapped off, then the jet can be interrupted by means of the closure device 19 so that a residual amount of liquid metal is retained in the second leg 12. A bath level h4 which has fallen in the first leg 11 of the discharge duct to below the level of the overflow edge 14 can be raised above the overflow edge 14, to initiate a fresh tapping procedure, by means of the vacuum device, possibly with incorporation of bath level regulation by means of the level sensor of the apparatus 40, and/or by the introduction of gas through the porous flushing or scavenging brick 36.

Figure 3:
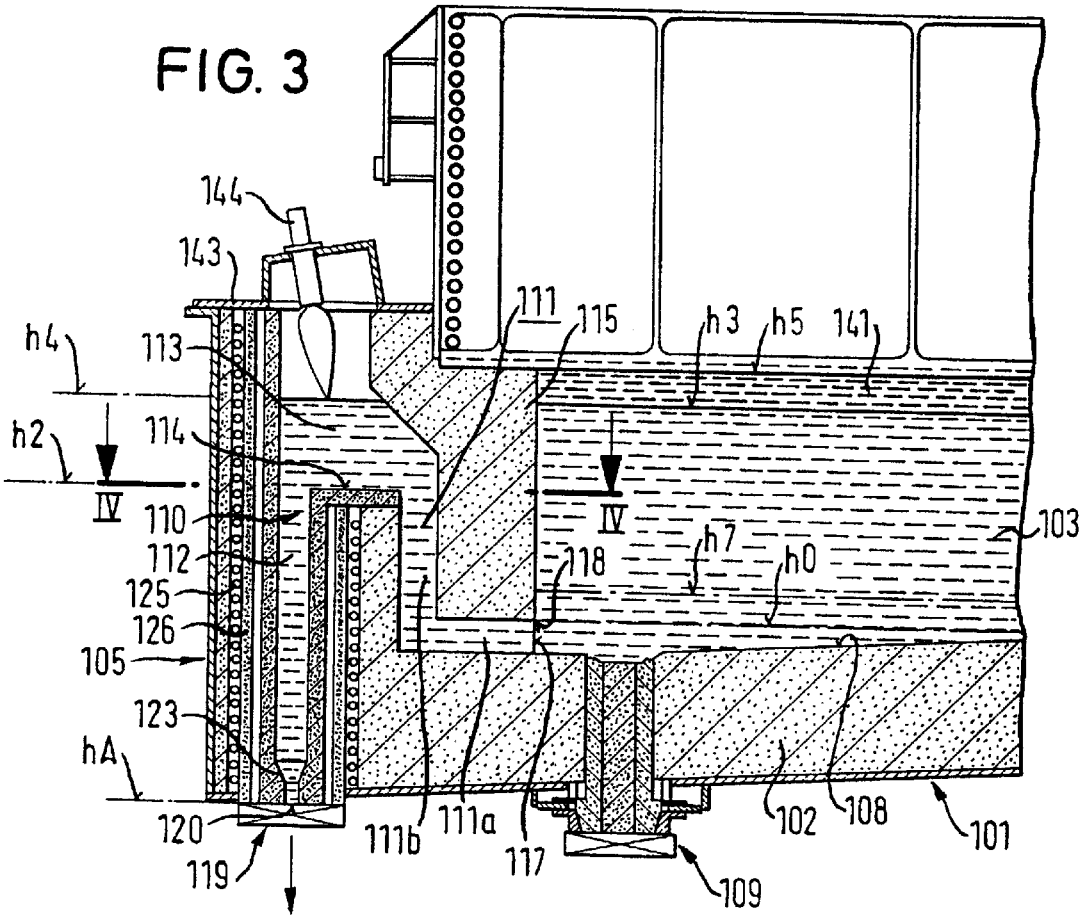
FIG. 3 shows the part, containing the tapping apparatus, of a tiltable vessel in the non-tilted condition, in a view corresponding to FIG. 2, with a modified form of the discharge duct.
Figure 4:
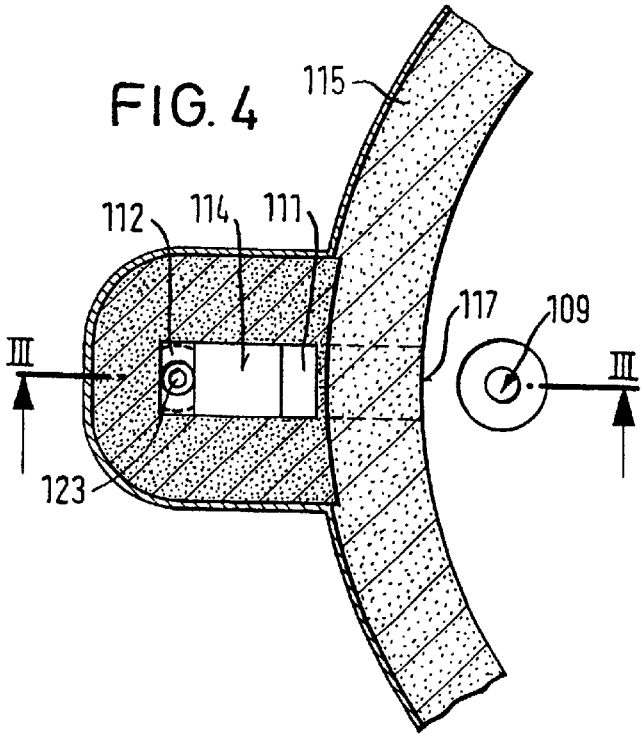
FIG. 4 shows the section IV—IV in FIG. 3.
Figure 5:
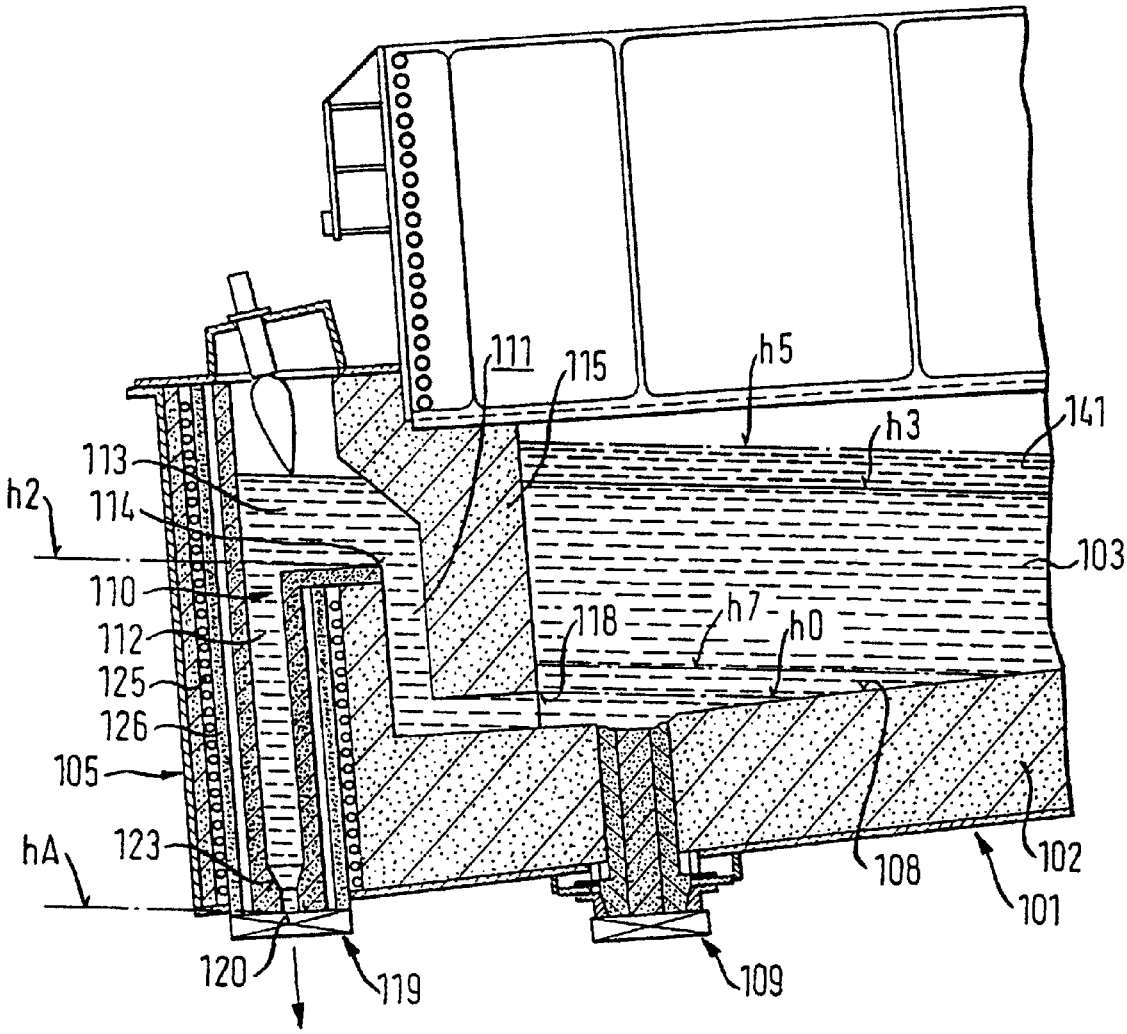
FIG. 5 shows the part of the tiltable vessel, shown in FIG. 3, in the tilted condition.

The part, shown in FIGS. 3 to 5, of a tiltable metallurgical vessel 101—parts which correspond to those of the vessel in FIG. 1 or FIG. 2 are denoted by reference numerals increased by 100—has a tapping apparatus 105 which is modified in relation to the metallurgical vessel of FIG. 1. The first leg 111 of the discharge duct 110, which passes through the refractory vessel wall 115 of the lower vessel portion 102 has a horizontal first portion 111*a* and a vertical second portion 111*b* which is connected to the second leg 112 by way of an enlarged connecting region 113. In addition the overflow edge 114 of the discharge duct 110 is set lower and instead of a gas-tight closure above the enlarged connecting region 113 there is provided a cover 143 with a burner 144 which passes through the cover and with which the enlarged connecting region or molten metal therein can be heated. The closure of the connecting region 113, which is afforded by the cover 143, can be of gas-tight nature. That however is not a necessary condition as by virtue of the overflow edge 114 being set lower a slag-free tapping operation can be initiated and executed even when the connecting region 113 is not air-tightly closed off by the cover 143.

By virtue of the horizontal arrangement of the first portion 11*a* of the first leg 111 adjoining the bottom contour 108 of the lower vessel portion 102 and a configuration of the through-flow cross-section of the discharge duct 110 at least in the region of the inlet opening 117 of the first leg 111 of rectangular or oval shape with a greater width than height, it is possible on the one hand for the flow speed of the metal, which is limited by the portion 123 of reduced through-flow cross-section, at the discharge duct inlet opening 117, to be kept down, while on the other hand it is possible for the upper edge 118 of the inlet opening 117 of the discharge duct to be displaced downwardly further than when the inlet opening 117 of the discharge duct is of a round cross-section. The ratio between the crosssection of the inlet opening 117 of the discharge duct and the cross-section of the portion 123 delimiting the through flow is about 4:1. In comparison with the configuration shown in FIGS. 1 and 2, in which the first leg 111 of the discharge duct 110 rises inclinedly and thus the upper edge 18 of the inlet opening 17 of the discharge duct is of an acute-angled configuration, the horizontal configuration of the first portion 110*a* in the embodiment shown in FIGS. 3 to 5 affords the advantage that, due to the right-angled configuration of the upper edge 118, it acquires a greater service life so that even after several hundreds of tapping operations the upper edge 118 of the inlet opening 117 of the discharge duct is displaced only immaterially upwardly due to wear. That means on the other hand that the overflow edge 114 can be moved down virtually to the level h7 and nonetheless after a relatively long period of operation slag-free tapping is guaranteed, because of the small amount of wear in the region of the upper edge 118.

The metallurgical vessel shown in FIGS. 3 to 5 is adapted to be tiltable. FIG. 3 shows the neutral or working position of the vessel and FIG. 5 shows the tilted position. The tilt angle is between about three and five degrees. In the case of a tiltable vessel the maximum tilted condition is crucial in terms of establishing the minimum height of the overflow edge 114, in other words, in the tilted condition shown in FIG. 5, to ensure slag-free tapping, the height h2 of the overflow edge 114 is not to be below the height h7 at which, due to intake eddies, slag 141 floating on the molten metal 103 is drawn into the discharge duct 110 over the overflow edge 118 of the inlet opening 117 of the discharge duct. If, when the vessel is in the tilted condition, the height h2 of the overflow edge 114 is approximately at the height of the surface of the bath h7 or only slightly higher, then the slag-free tapping operation can be implemented as far as the height h7 of molten metal 103 remaining in the vessel 101, without having to make use of a suction effect as a consequence of sealing closure above the connecting region 113.

What is claimed is:

1. A metallurgical vessel having a tapping apparatus for controlled slag-free withdrawal of liquid metal from a molten metal bath in a lower vessel portion, wherein the tapping apparatus includes a discharge duct which is surrounded by refractory material, the discharge duct including first and second downwardly facing legs with respective tops at which said legs are connected to define a connecting region of said first and second legs, the first leg passes through a side wall of the vessel and has an inlet opening for liquid metal, the inlet opening including an upper edge the second leg has a lower outlet opening for the liquid metal, which can be closed by a closure device, and the discharge duct includes an overflow edge for the liquid metal in the connecting region of the first and second legs, the overlow edge disposed at a height greater than a height of the upper edge of the inlet opening of the discharge duct, characterised in that the first leg of the discharge duct passes through a refractory cladding of the side wall of the lower vessel portion and is integrated into same, in the working position of the vessels the overflow edge is arranged lower than an upper edge of the refractory cladding of the side wall but at a maximum at a height defined by the maximum permissible bath level of the molten metal, and a heating device is provided for heating at least a part of at least one of the refractory material surrounding the discharge duct and a molten metal in the discharge duct.

2. A metallurgical vessel according to claim 1 characterised in that arranged in the connecting region of the first and second legs of the discharge duct is at least one pipe connection which is lined with refractory material and which by means of a flange can be at least one of closed and connected to at least one external device.

3. A metallurgical vessel according to claim 2 characterised in that at least one of the first and second legs of the discharge duct has a pipe connection which is aligned with the respective leg.

4. A metallurgical vessel according to claim 2 characterised in that the flange is provided with a connecting pipe to which a vacuum device can be connected, as an external device, by way of a first valve.

5. A metallurgical vessel according to claim 4 characterised in that the flange is provided with a connecting pipe which can be communicated with the free atmosphere by way of a second ventilation valve.

6. A metallurgical vessel according to claim 1 characterised in that there is provided a device for detecting and possibly controlling a height of the level of the bath in the connecting region of the first and second legs of the discharge duct.

7. A metallurgical vessel according to claim 6 characterised in that provided in conjunction with a vacuum device which can be set to a constant pressure is a level sensor which detects the height of the bath level in the connecting region of the first and second legs of the discharge duct and which supplies control signals to a regulating valve which is disposed in a gas conduit communicating the connecting region with the free atmosphere.

8. A metallurgical vessel according to claim 1 characterised in that at least one of a porous flushing and a scavenging brick which can be connected to a pressurised gas source by way of a pressurised gas line opens in the proximity of the inlet opening of the discharge duct for the introduction of a gas into at least one of the interior of the vessel and the discharge pipe.

9. A metallurgical vessel according to claim 8 characterised in that at least one of the flushing and scavenging brick opens into the through-flow duct of the discharge duct at the underside and/or at the top side of the first leg.

10. A metallurgical vessel according to claim 2 characterised in that in the working position of the vessel, the flange of the pipe connection is higher than the height defined by the maximum permissible level of the molten metal bath.

11. A metallurgical vessel according to claim 1 characterised in that in the working position of the.vessel, the overflow edge is higher than a level of the molten metal bath, at which slag is drawn into the discharge pipe from the layer of slag floating on the molten metal, said slag being drawn into the discharge pipe by intake eddies above the upper edge of the inlet opening of the discharge duct.

12. A metallurgical vessel according to claim 1 characterised in that in the working position of the vessel,the overflow edge is lower than a level of a bottom of a slag discharge opening which is provided in the vessel wall.

13. A metallurgical vessel according to claim 12 characterised in that in the working position of the vessel, the overflow edge is approximately at a height which is defined by the maximum permissible level of the molten metal bath.

14. A metallurgical vessel according to claim 1 characterised in that the first leg of the discharge duct passes through the refractory vessel wall, rising inclinedly as viewed from the interior of the furnace.

15. A metallurgical vessel according to claim 1 characterised in that the first leg of the discharge duct includes a horizontal first portion and a vertical second portion which is connected to the second leg by way of the connecting region.

16. A metallurgical vessel according to claim 1 characterised in that the second leg of the discharge duct is arranged within a bay-like projection of the furnace vessel.

17. A metallurgical vessel according to claim 1 characterised in that a portion of reduced through-flow cross-section, for restricting the through-flow, is provided in the second leg of the discharge duct.

18. A metallurgical vessel according to claim 17 characterised in that the portion of reduced through-flow cross-section is arranged just in front of the outlet opening of the discharge duct.

19. A metallurgical vessel according to claim 17 characterised in that the portion of reduced through-flow cross-section is replaceable.

20. A metallurgical vessel according to claim 17 characterised in that a through-flow cross-section of the discharge duct, at least in the region of the inlet opening of the first leg, is one of a rectangular configuration and an oval configuration of greater width than height.

21. A metallurgical vessel according to claim 20 characterised in that a ratio between the cross-section of the discharge duct outlet opening and the reduced through-flow cross-section is about 4:1.

22. A metallurgical vessel according to claim 2 characterised in that the heating device can be connected to the pipe connection.

23. A metallurgical vessel according to claim 2 characterised in that a container with granular refractory material can be connected by way of a metering device to a pipe connection which is aligned with the second leg of the discharge duct.

24. A metallurgical vessel according to claim 1 characterised in that the heating device has at least one induction coil which surrounds the first and/or second leg of the discharge duct.

25. A metallurgical vessel according to claim 1 characterised in that the closure device of the outlet opening of the discharge duct includes a closure plate member which is movable repeatedly by means of a drive from a closing position of bearing against the edge of the outlet opening into an open position of opening the outlet opening, and from the open position into the closing position.

26. A metallurgical vessel according to claim 1 characterised in that the inlet opening of the discharge pipe is arranged adjacent to a bottom of the vessel.

27. A metallurgical vessel according to claim 1 characterised in that the vessel is adapted to be tiltable in the direction of the tapping apparatus.

28. A metallurgical vessel according to claim 1 characterised in that the height of the overflow edge is higher than a height of the surface of the bed of molten metal present in the vessel, in which intake eddies cause slag floating on the molten metal to be drawn into the discharge duct over the overflow edge of the inlet opening of the discharge duct.

29. A tapping apparatus for a metallurgical vessel having a liquid metal bath, the tapping apparatus including:

- a discharge duct surrounded by refractory material, the discharge duct including
  - a first leg passing through a refractory cladding of a side wall of the vessel, the first leg including an inlet opening for liquid metal,
  - a second leg connected to the first leg at a connecting region, the second leg having an outlet opening for liquid metal, and
  - an overflow edge disposed in the connecting-region, the overflow edge being disposed at a height lower than an upper edge of the refractory cladding of the side wall and lower than a maximum permissible bath level of the liquid metal bath.

30. The tapping apparatus of claim 29, wherein the discharge duct further includes

- at least one pipe connection disposed in the connecting region, the at least one pipe connection being lined with refractory material, the at least one pipe connection capable of being at least one of closed by a flange and connected to at least one external device by a flange.

31. The tapping apparatus of claim 30, wherein at least one of the first and second legs includes a pipe connection aligned with the respective leg.

32. The tapping apparatus of claim 30, wherein the flange includes a connecting pipe for an external vacuum device.

33. A tapping apparatus for a metallurgical vessel having a liquid metal bath, the tapping apparatus including:

- a discharge duct surrounded by refractory material, the discharge duct including
  - a first leg passing through and integrated into a refractory cladding of a side wall of the vessel, the first leg including an inlet opening for liquid metal, the inlet opening including an upper edge, a second leg connected to the first leg at a connecting region, the second leg having an outlet opening for liquid metal, and an overflow edge disposed in the connecting region, the overflow edge being disposed at a height greater than the upper edge of the inlet opening of the discharge duct, the overflow edge being disposed at a height lower than an upper edge of the refractory cladding of the side wall.

34. The tapping apparatus of claim 33, wherein the discharge duct further includes at least one pipe connection disposed in the connecting region, the at least one pipe connection being lined with refractory material, the at least one pipe connection capable of being at least one of closed by a flange and connected to at least one external device by a flange.

35. The tapping apparatus of claim 34, wherein at least one of the first and second legs includes a pipe connection aligned with the respective leg.

* * * * *

UNITED STATES PATENT AND TRADEMARK OFFICE

CERTIFICATE OF CORRECTION

PATENT NO. : 6,596,221 B1
DATED : July 22, 2003
INVENTOR(S) : Gerhard Fuchs

It is certified that error appears in the above-identified patent and that said Letters Patent is hereby corrected as shown below:

Title page,
Item [54], Title, replace "METALLURGICAL VESSEL HAVING A TAPPING DEVICE AND METHOD FOR THE CONTROLLED, SLAG-FREE EXTRACTION OF MOLTEN METAL FROM SAID VESSEL" with
-- METALLURGICAL VESSEL HAVING A TAPPING APPARATUS AND PROCESS FOR THE CONTROLLED SLAG-FREE WITHDRAWAL OF LIQUID METAL FROM SAID VESSEL --.

Column 10,
Line 34, replace the word "vessels" with -- vessel, --.

Signed and Sealed this

Second Day of December, 2003

JAMES E. ROGAN
*Director of the United States Patent and Trademark Office*